United States Patent [19]

Ueno et al.

[11] Patent Number: 4,494,857

[45] Date of Patent: Jan. 22, 1985

[54] IMAGING METHOD USING A CHARGED INSULATING LAYER

[75] Inventors: Tsuyoshi Ueno; Shinichi Hashimoto, both of Fujisawa; Kouzou Matsuyama, Yokohama; Nobutaka Wakao, Kawasaki, all of Japan

[73] Assignee: Tokyo Shibaura Denki Kabushiki Kaisha, Kawasaki, Japan

[21] Appl. No.: 484,485

[22] Filed: Apr. 13, 1983

Related U.S. Application Data

[63] Continuation of Ser. No. 252,194, Apr. 8, 1981, abandoned.

[30] Foreign Application Priority Data

Apr. 11, 1980 [JP] Japan ..... 55-47781

[51] Int. Cl.[3] ..... G03G 15/052

[52] U.S. Cl. ..... 355/3 CH; 355/77; 430/31; 430/902; 361/221

[58] Field of Search ..... 355/3 CH, 14 CH, 77; 430/31, 902; 361/220, 221

[56] References Cited

U.S. PATENT DOCUMENTS 2,774,921 12/1956 Walkup ..... 355/3 CH 3,671,806 6/1972 Whitmore et al. ..... 361/221 X 3,993,021 11/1976 Kline ..... 355/3 TR 4,095,980 6/1978 Satomi ..... 355/15 X

FOREIGN PATENT DOCUMENTS 1797577 11/1977 Fed. Rep. of Germany .

OTHER PUBLICATIONS

*Patent Abstracts of Japan,* vol 4, No. 58, Apr. 30, 1980, p. 151p9.

*Primary Examiner*—Richard L. Moses

*Attorney, Agent, or Firm*—Cushman, Darby & Cushman

[57] ABSTRACT

An electrophotographic imaging method comprises a first process for charging an electrically insulating layer formed on the surface of a photosensitive drum, and a second process for image-exposing the charged insulating layer to form an electrostatic latent image thereon. The first process includes a first step for bringing a pliable contactor having a specific electric resistance of $10^8$ Ω·cm in contact with the insulating layer, and a second step for impressing a voltage on the contactor in contact with the insulating layer by means of an electrode having a specific resistance lower $10^5$ to $10^7$ Ω·cm. Thus the insulating layer is charged.

7 Claims, 8 Drawing Figures

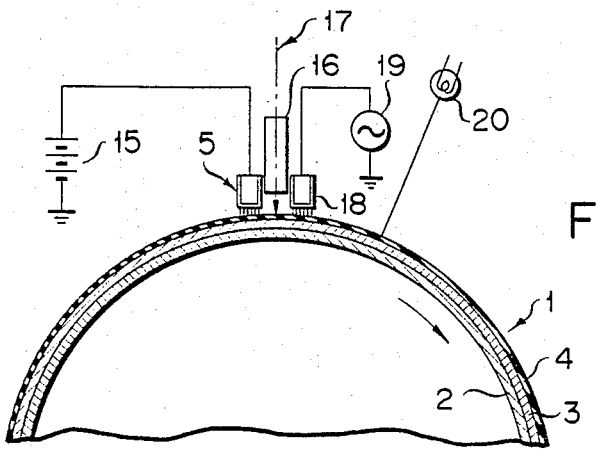
FIG. 1
FIG. 2
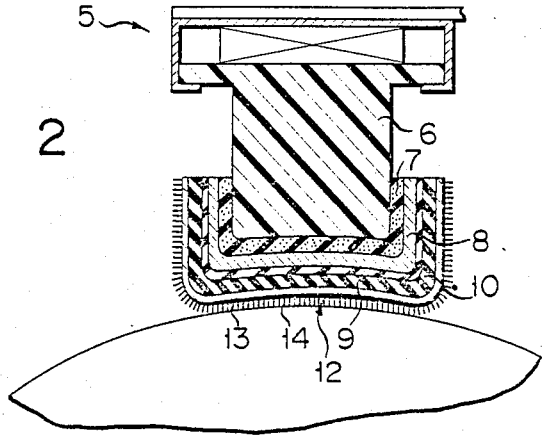
FIG. 3
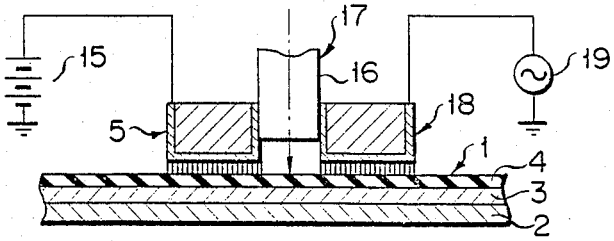

IMAGING METHOD USING A CHARGED INSULATING LAYER

This is a continuation of application Ser. No. 252,194, filed 4/8/81, now abandoned.

The present invention relates to an electrophotographic imaging method using a photosensitive body, more particularly to an electrophotographic imaging method using a photosensitive body with an electrically insulating layer formed on the surface thereof.

Conventionally, in an electrophotographic imaging method in which the surface of a photosensitive body is subjected to charging and image-exposure processes, etc. to form an electrostatic latent image on the surface, a corona discharger is used as a charger for charging the surface of the photosensitive body. The corona discharger, however, involves various problems, such as the danger of the use of high voltage, the possibility of air pollution or contamination of other devices or equipment by ozone produced during discharging process and expensiveness, etc.

Meanwhile, there have long been tried various contact-type chargers using rollers or brushes. With the chargers provided so far, however, the surface of the photosensitive body may be damaged mechanically or electrically. By the use of the charges of this type, therefore, the life of the photosensitive body would greatly be shortened.

The present invention has been accomplished in view of the above-mentioned circumstances, and is intended to provide an electrophotographic imaging method in which a photosensitive body with an electrically insulating layer formed on the surface thereof is charged by contact and exposed to form an electrostatic latent image thereon, thus ensuring uniform and easy charging or electrification.

According to an aspect of the present invention, there is provided a electrophotographic imaging method which comprises a first process for charging an electrically insulating layer formed on the surface of a photosensitive body, and a second process for image-exposing the charged insulating layer to form an electrostatic latent image thereon, wherein the first process includes a first step for bringing a pliable contactor having a prescribed electric resistance in contact with the insulating layer, and a second step for impressing a voltage on the contactor in contact with the insulating layer by means of an electrode having a resistance lower than the prescribed electric resistance of the contactor, whereby the insulating layer is charged.

This invention can be more fully understood from the following detailed description when taken in conjunction with the accompanying drawings, in which:

FIG. 1 is a sectional view showing an embodiment of the electrophotographic imaging method according to the present invention;

FIG. 2 is a sectional view showing a charger used for the electrophotographic imaging method shown in FIG. 1;

FIG. 3 is a sectional view showing a charging process;

Figure 4A:
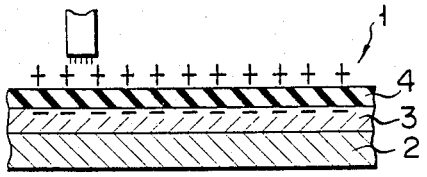
FIGS. 4A to 4D are sectional views showing different charging states created in a photosensitive body by the charging process.

Now there will be described an embodiment of the electrophotographic imaging method according to the present invention with reference to the accompanying drawings.

In FIG. 1, reference numeral 1 designates a photosensitive drum as a photosensitive body which is supported rotatably in a casing (not shown). The photosensitive drum 1 includes a cylindrical base 2 formed of an electrically conductive material, and a photosensitive layer 3 formed of an N-type photoconductive material and laid on the outer circumferential surface of the base 2. Provided on the outer circumferential surface of the photosensitive drum 1, that is, on the surface of the photosensitive layer 3, is an electrically insulating layer 4 which is formed of an electrically insulating material with smooth surface, such as e.g. a polyester film (manufactured by E. I. du Pont with the trademark "Mylar"). The photosensitive drum 1 is driven by a driving mechanism (not shown) to rotate in the clockwise direction as indicated by an arrow in FIG. 1.

Around the photosensitive drum 1, a first charger 5 for charging the photosensitive drum 1 lies in contact with the insulating layer 4 along the axial direction of the drum 1. As expressly shown in FIG. 2, the first charger 5 includes a substantially rectangular charger base 6 extending along the axial direction of the photosensitive drum 1. The charger base 6 is made of a synthetic resin material such as acrylic or ABS resin.

A cushion layer 7, heater layer 8, insulating layer 9, electrode 10, and contactor 12 are successively put in layers on that bottom of the charger base 6 which faces the outer circumferential surface of the photosensitive drum 1. These several layers extend from the underside to both flanks of the charger base 6, thereby covering the bottom portion of the charger base 6.

The cushion layer 7 is formed of a foamed synthetic resin sheet with a thickness of approximately 3 mm, and has an electrically insulating function as well as a cushioning function. The heater layer 8 is intended to heat the contactor 12 continually lest the contactor 12 should get damp to change its resistance value. The heater layer 8 is formed of a low-power heater rated for several watts. The insulating layer 9 is intended to electrically insulate the heater layer 8 in cooperation with the cushion layer 7. The insulating layer 9 is formed of a polyester film (manufactured by E. I. du Pont with the trademark "Mylar") with a thickness of approximately 25 μm.

The electrode 10 is formed of an electrically conductive rubber sheet with a thickness of approximately 50 μm. The conductive rubber sheet is formed by blending first and second solutions of the following compositions at a ratio of 1:1. The first solution is obtained by mixing 82.5 wt. % of solvent with 17.5 wt. % of solid component which is a mixture of 30 wt. % of carbon (manufactured by CABOT Co. with the trademark "VULCAN XC-72"), 50 wt. % of SBR (manufactured by ASAHI KASEI KOGYO K. K. with the trademark "TUFPRENE") and 20 wt. % of xylene resin (manufactured by MITSUBISHI GAS KAGAKU K. K. with the trademark "NIKANOL"), while the second solution is obtained by mixing 50 wt. % of solvent such as toluene with 50 wt. % of the SBR. With such composition, the specific resistance of the electrode 10 is maintained at $10^5$ to $10^7$ Ω·cm.

In this embodiment, the contactor 12 is formed of piled cloth having a specific resistance higher than that of the electrode 10. Used for this cloth is velveteen having a specific resistance of $10^8$ Ω·cm. The velveteen cloth is formed of a cotton fiber base 13 and a multitude of furs 14 planted in and protruding from the fiber base 13. Each of these furs 14 is made of an electrically conductive nylon fiber. The fur 14 may have a thickness of 1.5 to 10 d (deniers) and a length of 0.5 to 3 mm, and in the embodiment, is set to 5 d in thickness and 2 mm in length. The contactor 12 thus constructed is bonded to the electrode 10 by means of an electrically conductive adhesive agent.

The electrode 10 is connected to a biasing D.C. power source 15 having an output of e.g. 1,000 V. The first charger 5 is attached to a casing (not shown) so that its furs 14 may be in contact with the insulating layer 4 on the outer circumferential surface of the photosensitive drum 1.

A focusing phototransmitter 16 is disposed in a position facing that portion of the insulating layer 4 on the outer circumferential surface of the photosensitive drum 1 which extends along the axial direction of the photosensitive drum 1 and adjoining the first charger 5 along the rotating direction of the photosensitive drum 1. The focusing phototransmitter 16 constitutes a part of an optical system 15 for image exposure.

In contact with the insulating layer 4, a second charger 18 is disposed in a position adjoining the focusing phototransmitter 16 along the rotating direction of the photosensitive drum 1. The second charger 18 has the same construction as that of the first charger 5 shown in FIG. 2. A biasing A.C. power source 19 is connected to an electrode of the second charger 18.

An exposure lamp 20 for exposing the photosensitive layer 4 along the axial direction of the photosensitive drum 1 is disposed in a position at a given distance from the second charger 18 along the rotating direction of the photosensitive drum 1. Detailed description of other components constituting the copying process, such as a developing unit, transfer unit, cleaning unit, etc., is omitted herein since conventional ones may be used directly for them.

Referring now to FIGS. 3 and 4A to 4D, there will be described the electrophotographic imaging method using the aforementioned mechanism.

First, when the photosensitive drum 1 starts to rotate, a voltage of D.C. 1,000 V from the biasing D.C. power source 15 is impressed on the first charger 5. By such impression, as shown in FIG. 4A, the insulating layer 4 is charged positively. In response to the positive charging of the insulating layer 4, negative charges from the base 2 are implanted into the photosensitive layer 3 to exist latently therein.

Figure 4B:
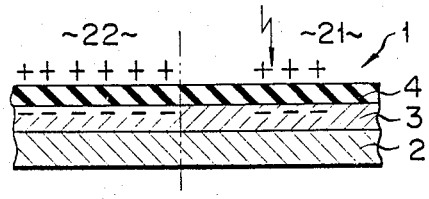

Thereupon, the photosensitive layer 3 and the insulating layer 4 are exposed by the optical system 17 for image exposure correspondingly to an image to be copied. On such exposure, an A.C. voltage is applied to the image-exposed photosensitive layer 3 and insulating layer 4 by the second charger 18. Namely, as shown in FIG. 4B, the photosensitive layer 3 and the insulating layer 4 are divided by the image exposure into light and dark parts 21 and 22 corresponding to light and dark parts of the image.

Figure 4C:
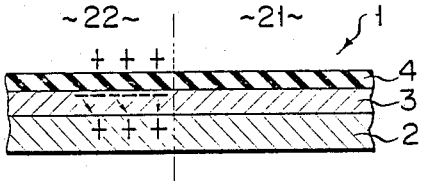

At the light part 21, a part of the positive charges put on the insulating layer 4 by the first charger 5 are discharged. By the impression of the A.C. voltage through the second charger 18, the remaining charges on the insulating layer 4 are thoroughly removed, as shown in FIG. 4C.

At the dark part 22, on the other hand, some of the surface charges or positive charges on the insulating layer 4 are discharged by the impression of the A.C. voltage by the second charger 18. However, the greater part of the surface charges remain on the insulating layer 4.

Figure 4D:
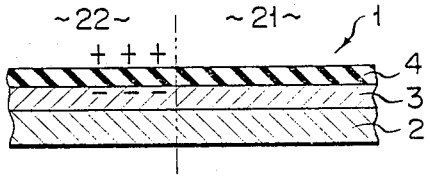

Then, at the dark part 22, those latent negative charges in the photosensitive layer 3 which correspond to the number of positive charges reduced by the second charger 18 are drawn into the conductive base 2 by positive charges generated therein. As shown in FIG. 4D, therefore, those negative charges which correspond to the number of surface charges or positive charges on the insulating layer 4 stay latently in the photosensitive layer 3 at the dark part 22, whereas all the charges are removed at the light part 21. That is, an electrostatic latent image having a contrast corresponding to that of the image to be copied is formed on the surface of the insulating layer 4.

Figure 5:
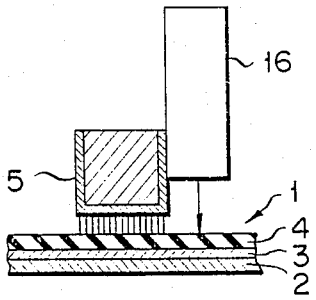
FIG. 5 is a sectional view showing a modification of the arrangement of both the charger and a focusing phototransmitter shown in FIG. 3.

This invention is not limited to the above-mentioned embodiment, and various changes and modifications may be effected without departing from the scope or spirit of the invention. For example, in the above embodiment, the first charger 5, focusing phototransmitter 16, and second charger 18 are composed as a single unit. However, only the first charger 5 and the focusing phototransmitter 16 may be formed as a unit, as shown in FIG. 5. Alternatively, these three devices may be formed separately from one another.

According to this invention, as described above, a pliable contactor having a prescribed electrically specific resistance is brought in contact with a photosensitive body having an electrically insulating layer thereon, and a D.C. voltage is applied to the contactor by means of an electrode having a specific resistance lower than the prescribed specific resistance of the contactor, thereby charging the insulating layer.

Thus, unlike in the case where the photosensitive body is charged directly, no voltage gradient is needed to protect the photosensitive body from electrical damage at impression of a high voltage, so that the construction of the electrostatic copying apparatus according to the electrophotographic imaging method may be simplified. Since the contactor is not brought in direct contact with the surface of the photosensitive body, moreover, it is possible to use a photoconductive material with poor mechanical strength for the photosensitive layer. Further, the contact charging may provide a uniform charging state, and eliminate the possibility of contamination or corruption of the air or equipment due to ozone produced by corona discharge.

What we claim is:

1. An electrophotographic imaging method for reproducing an image comprising the steps of:

providing a photosensitive drum having a conductive base, a photosensitive layer over said base and an electrically insulating layer over said photosensitive layer;

charging, via a contact-type charger, positive charges on said insulating layer thereby bringing negative charges from said conductive base into said photosensitive layer to exist latently therein;

imaging exposing said photosensitive drum with an image to be reproduced having light and dark regions, the light regions causing some of the positive charges on said insulating layer to be discharged and the dark regions not substantially affecting charges on the insulating layer;

discharging, by applying via a contact-type charger an A.C. voltage to said photosensitive and insulating layers, the A.C. voltage substantially removing from said insulating layer any remaining charges in said light regions while not removing all of the charges in said dark regions thereby rendering said light regions substantially charge-free with said dark regions having charges remaining thereon, latent negative charges in said photosensitive layer corresponding in number to the positive charges reduced by said discharging step being drawn into said conductive base by positive charges generated therein, those negative charges corresponding in number to the number of positive charges on said insulating layer existing latently in said photosensitive layer at said dark regions, the photosensitive and insulating layers being substantially charge free at said light regions, thereby forming a latent image having a contrast corresponding to the image to be reproduced.

2. A method according to claim 1, wherein said charging and discharging steps are carried out using the same contact-type charger.

3. A method according to claim 1, wherein said charging and discharging steps are carried out using separate contact-type chargers.

4. A method according to claim 1, further comprising, during the discharging step, the step of exposing said drum to light.

5. A method according to claim 2, further comprising, during the discharging step, the step of exposing said drum to light.

6. A method according to claim 3, further comprising, during the discharging step, the step of exposing said drum to light.

7. A method according to claim 1, wherein said charging step comprises the steps of:

providing a pliable contact-type charger having a first predetermined electrical resistance;

bringing said charger into the contact with said insulating layer; and connecting said charger with an electrode having a lower electrical resistance than said charger and carrying a voltage for positively charging said insulating layer.

* * * * *